United States Patent [19]

Jones et al.

[11] Patent Number: 4,525,697

[45] Date of Patent: Jun. 25, 1985

[54] THERMALLY RESPONSIVE CONTROLLER AND SWITCH ASSEMBLY THEREFOR

[75] Inventors: William H. Jones, Villa Park; Worthy L. Chambers, Lombard, both of Ill.

[73] Assignee: Eaton Corporation, Cleveland, Ohio

[21] Appl. No.: 449,041

[22] Filed: Dec. 13, 1982

[51] Int. Cl.[3] ..... H01H 37/52

[52] U.S. Cl. ..... 337/354; 200/283; 337/340

[58] Field of Search ..... 337/354, 365, 372, 375, 337/340, 373; 200/283, 83 P, 67; 335/133, 188

[56] References Cited

U.S. PATENT DOCUMENTS

| | | | |
|---|---|---|---|
| 3,719,788 | 3/1973 | Holland et al. | 200/283 |
| 4,091,354 | 5/1978 | Deubel et al. | 337/365 |
| 4,103,271 | 7/1978 | Taylor et al. | 337/372 |
| 4,220,835 | 9/1980 | Storz et al. | 200/283 |
| 4,339,738 | 7/1982 | Colavecchio | 337/354 |

*Primary Examiner*—Harold Broome

*Attorney, Agent, or Firm*—C. H. Grace; R. A. Johnston

[57] ABSTRACT

A thermostat having a low force output, snap-acting thermally responsive bi-metal disc operative through a pushrod to move the blade of an SPDT switch at a pre-selected temperature. The switch has a cantilever blade formed of a unitary thin metal strip having a flexible stem with a first rigid tongue extending therefrom with a heavy current carrying moveable contact thereon for a normally closed contact set. The pushrod contacts the rigid first tongue for switch actuation. A second flexible tongue extends from the stem and has an integral low current normally open contact thereon for a contact set which is closed upon switch blade actuation. Upon further temperature rise, after switch actuation, pushrod over-travel on the first tongue is absorbed by resilient flexing of the stem and second tongue thereby providing a wiping action to the closed low current contact set.

18 Claims, 3 Drawing Figures

THERMALLY RESPONSIVE CONTROLLER AND SWITCH ASSEMBLY THEREFOR

BACKGROUND OF THE INVENTION

The present invention relates to thermostatically actuated electrical switches and in particular to such switches having a single pole double throw type of switching function. Switches of this type are often employed in the programming control system for household appliances such as washing machines and dishwashers.

In applications for domestic applicances, it is sometimes required to employ an SPDT switch wherein one set of contacts is required to switch a relatively high current load, whereas, the other set of contacts will be required to switch only a very light current load. In such applications, it has been found desirable to limit the contact forces of the two sets of contacts to the absolute minimum in order to reduce the force required to actuate the switch mechanism. This is particularly a problem area in designing switches for applications requiring a high degree of thermal sensitivity where the thermal sensing means is able to provide only a minimum force for actuating the electrical switching mechanism.

Where one set of contacts of the switch is utilized for switching very low current and has a low contact force, it has been found desirable to provide the contacts with a wiping action to remove any accumulation of oxidation deposits on the contact surfaces from lowering the surface conductivity of the contacts.

In applications where one set of contacts is required to switch high current loads, it is desirable to have the switching performed in a snap-action mode to prevent arcing and burning of the contacts.

Thus, it has been desired to provide an SPDT switch having the capability of switching a low current load on one set of contacts and providing a wiping motion thereto; and yet provide the other set of contacts with the snap-action required to switch a high current load.

Heretofore, it has been difficult to provide such an SPDT which is capable of being actuated by a low force output thermally responsive actuator in applications where the switch is employed as a thermostatic switching controller and combine high current switching and low current switching while maintaining a high degree of thermal sensitivity for the control function.

SUMMARY OF THE INVENTION

The present invention provides a solution to the above described problem by a novel way or means of effecting a snap-action to one set of contacts on a SPDT switch for handling heavy current loads and simultaneously therewith a providing wiping action between the remaining set of contacts for switching a very low current load and yet requiring a low switch actuation force.

The novel switch assembly of the present invention includes in a common housing a thermally responsive actuator means capable of providing in response to experiencing a pre-selected elevated temperature sufficient movement to the blade means of the switch for effecting making and breaking of the contact sets. In the preferred embodiment, the thermally responsive means comprises a snap-acting bi-metal disc.

The switch blade means of the present invention comprises a unitary strip having a resiliently flexible stem portion fixed to the base or housing with a stiffened substantially rigid first tongue and a flexible second tongue each extending in cantilever therefrom with the normally opened and normally closed moveable contacts mounted on the tongue portions. The thermally responsive actuator contacts the first tongue to cause the stem portion of the strip to flex for effecting movement of the first and second tongue portions to the switch actuated position. As the sensor experiences increased temperatures above the pre-selected actuation temperature, overtravel of the actuator means against the stiffened first tongue portion is absorbed by flexing of the stem portion and the second tongue portion of the strip.

The present invention thus provides a unique thermally responsive switch controller assembly having a single pole double throw switch contact arrangement with a snap-action actuator for effecting rapid breaking of one contact set capable of carrying heavy current loads and means for providing a wiping action to the second contact set for very low current load switching. The present invention thus provides a snap-action bi-metal thermal sensor which provides a relatively high degree of thermal sensitivity and a switch blade means capable of responding to the low force output of the snap acting bi-metal sensor to switch a heavy current contact set and simultaneously provide a wiping action to a low current contact set.

DETAILED DESCRIPTION

Figure 1:
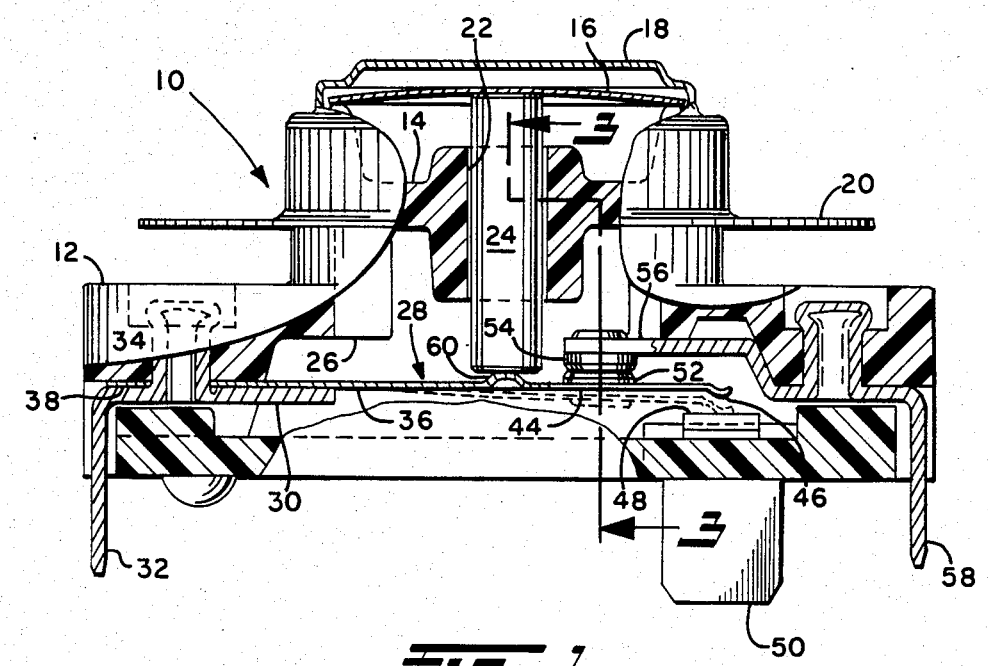
FIG. 1 is a side elevation view of the thermally responsive switch controller assembly of the present invention with portion of the casing broken away.

Referring now to the drawings the thermally responsive switch controller assembly of the present invention is indicated generally at 10 and has a base or housing 12 having a cavity 14 provided therein for receiving a thermal sensing means. The cavity 14 has received therein a thermal sensor in the preferred form of a snap-acting bi-metal disc 16 retained about its periphery by a cup 18, which in the preferred practice, has integrally formed therewith a suitable mounting flange 20. The bi-metal disc has a relatively high degree of thermal sensitivity for providing precise controller actuation, but has a relatively low actuation force output.

The base 12 has formed therein a guide bore 22 having actuating means in the form of pushrod 24 slidably received therein, with the upper end thereof contacting the surface of bi-metal disc 16.

The base 12 has a switch cavity or recess 26 formed therein with a switch blade means, indicated generally at 28, mounted therein and retained at one end thereof by an electrical terminal strip 30 which has a portion thereof 32 extending externally of the base 12 to form a common circuit connecting terminal for the switch. In the presently preferred practice, the terminal 30 has a portion 34 thereof deformed through an aperture in the blade means 28 for locating and securing the blade means and generally cantilever arrangement and a switching cavity 26.

Figure 2:
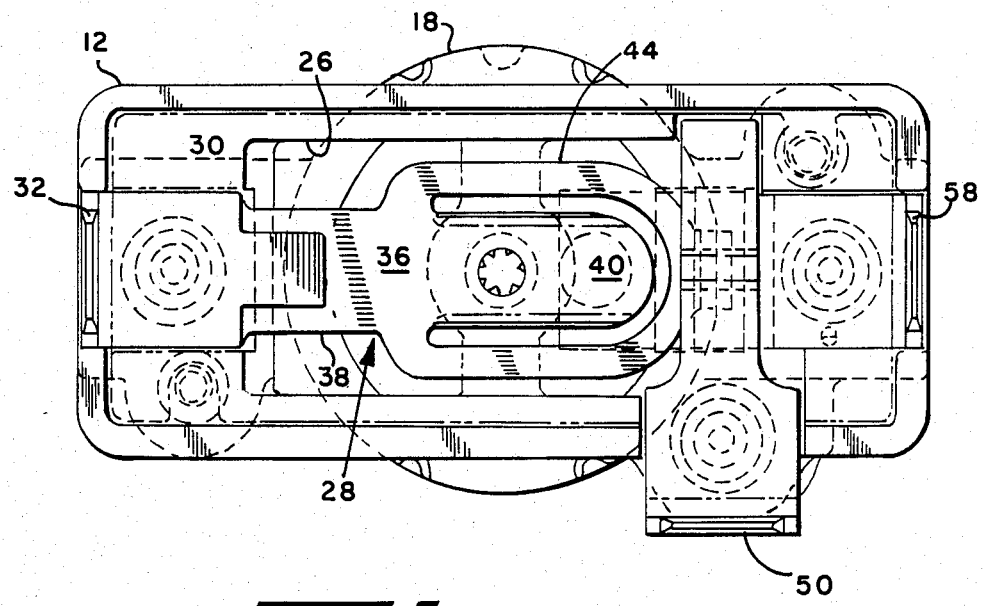
FIG. 2 is a bottom view of the controller assembly of FIG. 1.

Referring now particularly to FIGS. 1 and 2, the blade means 28 comprises a unitary strip 36 formed of resiliently flexible material and having a stem portion 38 having one end thereof anchored to the end portion retained by terminal 34. The stem portion 38 thus extends in cantilever from the base 12 and has a first stiffened tongue portion 40 extending therefrom longitudinally in cantilever arrangement.

Figure 3:
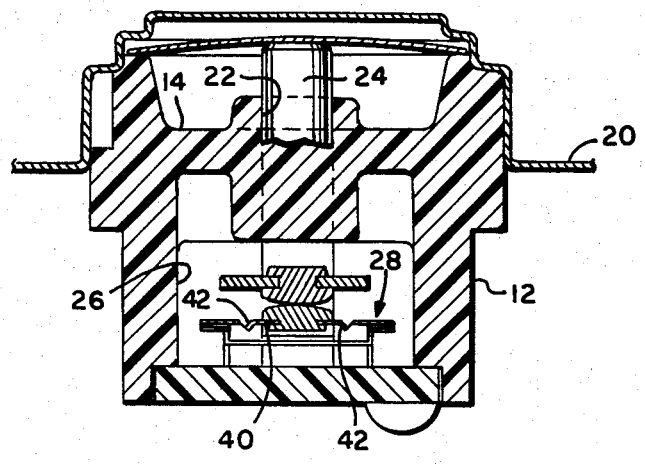
FIG. 3 is a sectional view taken along section-indicating lines 3—3 of FIG. 1.

Referring now to FIG. 3 the stem 40 has the longitudinal side thereof formed into stiffening flanges 42 for resisting flexing of the first tongue in the longitudinal direction.

A resiliently flexible second tongue portion 44 extends from the stem portion 38 of the blade strip 36 in longitudinal cantilever arrangement. In the presently preferred practice the second tongue portion 44 has a yoke-shaped configuration as illustrated in FIG. 2; and, is disposed about the first tongue portion 40 and has a moveable contact 46, preferably formed integrally therewith, provided on the free end thereof as shown in FIG. 1. The second tongue portion 44 is configured so as to have a resilient flexibility in the longitudinal direction substantially less than that of the first tongue portion 40. In the presently preferred practice, the second tongue portion, by virtue of its length, is substantially more flexible than the stem portion.

A normally open stationary electrical contact 48 is provided and is positioned adjacent the contact 46 on the free end of the second tongue portion of the blade strip 36. The normally opened contact 48 preferably comprises an internal portion of an electrical terminal strip 50 which also extends externally of the body 12 as illustrated in FIGS. 1 and 2 to form a normally open circuit connector.

With reference to FIG. 1 a moveable normally closed contact 52 is provided on the free end of the first tongue portion 40. A corresponding stationary normally closed contact 54 is provided adjacent to contact 52. Contact 52 is mounted on an electrical terminal strip 56 which has an externally extending portion 58 adapted for circuit connection thereto.

In the presently preferred practice the terminals 30, 58 are located and retained on the base 12, by internally deformed portion thereof received through operating in the base. However, it will be understood that other techniques for retention may be employed; as for example, discrete fasteners such as rivets.

In the present practice of the invention, the contact set 52, 54 is designed to carry heavy current loads of the order of 25 amperes at 230 volts AC; whereas, the contact set 46, 48 is intended to carry very low current loads of the order of 30 milliamperes at 120 volts AC.

The first tongue portion 40 has an actuation surface 60 provided thereon, which is in contact with the lower end of pushrod 24. In the presently preferred practice invention the contact surface 60 is formed by indenting or dimpling the first tongue portion 40 of the blade strip 36.

The switch assembly in the unactuated position is illustrated in solid outline in FIG. 1 with the contact set 54, 52 closed and the blade means 28 in the upper most position such that contact set 48, 46 is open.

In operation, upon the controller 10 experiencing increasing temperatures to a pre-selected temperature, the bi-metal disc 16 snaps to the downward position, illustrated by the dashed line in FIG. 1 thereby moving pushrod 24 downwardly and urging the rigid first tongue portion 40 of the blade in a downward direction such that the stem portion 38 of the blade strip flexes normally closed and, contact set 54, 56 is opened.

As the stem portion 38 flexes, the second tongue portion 44 is rotated about its attachment point to the stem portion, thereby causing contact 46 to close against contact 48.

As further increases in temperature are experienced by the bi-metal disc 16, overtravel of the pushrod 24 is thereafter absorbed by resilient flexing of the second tongue portion 44 and to a much lesser extent by flexing of the stem portion 38. In the overtravel absorbing mode, the first tongue portion 40 is rotated by flexing of the stem portion 38 but is substantially unflexed itself in the longitudinal direction by virtue of the stiffening flanges 42.

The present invention thus provides a unique thermally responsive snap-action switch controller wherein the thermal sensing means comprises a low force output snap-acting bi-metal disc. The switch has a single pole double throw arrangement. A unitary switch blade is employed having a resiliently flexible stem, a relative rigid first stem portion having the normally closed contact thereon and contacting the switch actuator associated with the thermal sensing means and a resiliently flexible second tongue portion for closing a normally open set of contacts. The second tongue portion is sufficiently resiliently flexible to provide a wiping action to the normally open contacts when closing. Actuator overtravel from the thermal sensor is thereafter absorbed by flexing of the second tongue portion.

Although the invention has hereinabove been described with respect to the presently preferred practice, those having ordinary skill in the art will recognize that the invention is capable of variations and modifications and is intended to be limited only by the following claims.

What is claimed is:

1. A thermally responsive switch controller assembly comprising:

(a) body means having a plurality of spaced electrical terminals mounted thereon and adapted for circuit connection thereto;

(b) first stationary contact means mounted on said body means and connected to one of said terminals;

(c) second stationary contact means disposed on said body means in spaced relationship to said first contact means and connected to another of said terminals;

(d) blade means having a first portion thereof stationary with respect to said body means and a second portion moveable with respect to said first and second stationary contact means, said second portion incuding moveable contact means;

(e) actuator means including thermally responsive means operative in response to experiencing a preselected temperature to move said blade means from a position completing a first circuit through said first stationary contact means to a position completing a second circuit through said second stationary contact means in which position said first circuit is broken;

(f) said blade means second portion having a resiliently flexible stem attached to said stationary portion and a substantially rigid first tongue means and resiliently flexible second tongue means extending in cantilever from said stem, said first tongue means including a first moveable contact, said second tongue means including a second moveable contact and said actuator means includes a member operatively contacting said first tongue means, whereupon exposure of said thermal means to said preselected temperature said actuator member moves said first tongue means by resilient flexing of said stem portion for effecting breaking of said first circuit and said second tongue is moved to effect completing said second circuit and thereafter upon further temperature increase further movement of said member substantially is absorbed by said resilient flexing and said second tongue means.

2. The switch controller assembly defined in claim 1, wherein said blade means comprises a unitary flat spring member with said first tongue having an elongated configuration with said second tongue having a yoke configuration and disposed about said first tongue.

3. The switch controller assembly defined in claim 1, wherein said blade means comprises a unitary elongated member having said first tongue means disposed within said second tongue means, said first and second tongue means extending in cantilever arrangement from said stem portion of said blade means with said second moveable contact disposed on the free end of said second tongue means and said first moveable contact disposed on the free end of said first tongue means.

4. The switch controller assembly defined in claim 1, wherein said blade means comprises a unitary generally planar member having an elongated configuration with its thickness substantially less than the width thereof, said first and second tongue means each comprise a member cantilevered from said stem portion with said first moveable contact disposed on the free end of said of said first tongue means, and said second moveable contact disposed on the free end of said second tongue means, said first tongue means having an actuation surface formed thereon intermediate with free end thereof and the base thereof, said actuation surface operatively contacting said actuator means.

5. The controller defined in claim 1, wherein said thermally responsive means comprises a bimetal member.

6. The controller assembly defined in claim 1, wherein said thermally responsive means comprises a bimetal member and said actuator means includes a guide means defined by said housing means and said member comprises a pushrod slidably received in said guide means.

7. The controller assembly defined in claim 1, wherein said thermally responsive means comprises a bimetal member and said actuator means includes pushrod means slidably received in said guide means, said pushrod means having one end thereof operatively contacting said bimetal member and the other end thereof operatively contacting said first tongue means.

8. The controller assembly defined in claim 1, wherein said thermally responsive means comprises a snap-acting bi-metal member.

9. A thermally responsive SPDT switch controller assembly comprising:

(a) body means having at least three spaced electrical terminals mounted thereon and adapted for circuit connection thereto;

(b) blade means having an end portion mounted on said body means and having a plurality of electrical contact means provided thereon, said blade means being operative, upon actuation, for movement of said contact means with respect to said body means;

(c) thermally responsive means including snap-acting means operable upon experiencing a pre-determined temperature to move said blade means and said contact means;

(d) said blade means comprising a generally thin flat strip of resiliently flexible material having an elongated configuration with one end thereof mounted on said body means and electrically connected to a first one of said electrical terminals, said blade means having a resiliently flexible stem attached to said mounted end and having a first and second spaced tongue means formed integrally therewith and extending in cantilever from said stem portion, said first tongue means configured so as to be substantially rigid and having one of said plurality of electrical contact means disposed thereon and said second tongue means resiliently flexible and having another of said contact means disposed thereon, said first tongue means including means defining an actuation surface in operative contact with said thermally responsive means for movement thereby;

whereupon said thermally responsive means experiencing said pre-determined temperature said stem portion is resiliently flexed and said first tongue means moves to break a normally closed circuit connection with a second of said electrical terminal means and is operative to cause said second tongue means to move with said first tongue means to complete a normally open circuit with a third of said electrical terminal means, said blade means thereafter at increased temperatures absorbing overtravel of said snap acting means by resilient flexing of said stem and said second tongue means.

10. The switch controller assembly defined in claim 9, wherein;

(a) said second tongue means extends a greater distance in the direction of elongation of said blade than said first tongue means and is more flexible than said stem;

(b) said blade means has the base of said second tongue means formed longitudinally intermediate said actuation surface and said mounted end portion and said blade means has the width thereof reduced in said stem portion to cause the substantially all of the resilient flexing of said pre-determined temperature to occur in said stem portion.

11. The switch controller assembly defined in claim 9, wherein said first tongue means has a moveable electrical contact mounted thereon adjacent the free end thereof and one of said terminals has a stationary electrical contact thereon and said stationary contact has the first moveable contact in normally closed arrangement therewith.

12. An improved single pole double throw switch assembly comprising:

(a) body means having a plurality of electrical terminals received thereon and adapted for external circuit connection thereto;

(b) normally closed electrical contact means electrically connected to a first one of said terminals;

(c) normally open electrical contact means electrically connected to a second one of said electrical terminals;

(d) blade means electrically connected to a third one of said electrical terminals and including moveable contact means, said third terminal operative as a common conductor for said first and second terminals, wherein said blade means comprises an elongated strip of resilient flexible material having a stem portion disposed in cantilever arrangement on said body means and having (i) a first tongue portion extending longitudinally of and cantilevered from said stem portion, said first tongue portion configured to be substantially rigid;

(ii) a second tongue portion cantilevered at its base from said stem portion and extending longitudinally thereof, said second tongue portion being resiliently flexible;

(iii) said first tongue having an actuation surface provided thereon intermediate the free end thereof and the base thereof;

(e) means defining a first moveable contact disposed adjacent the free end of said first tongue;

(f) means defining a second moveable contact disposed adjacent the free end of said second tongue;

(g) plunger means operative upon actuation to contact said actuation surface and effect movement of said blade means, wherein said stem portion is resiliently flexed and said first moveable contact is moved to break a circuit with said normally closed contact and said second tongue portion is moved substantially without flexing to effect making of a circuit between said second moveable contact and said normally open contact, and thereafter, further movement of said actuator means is absorbed by resilient deformation of said stem portion said second tongue means and for effecting wiping between said closed contacts.

13. The switch assembly defined in claim 12, wherein said first and second tongue portions extend longitudinally in spaced generally parallel arrangement.

14. The switch assembly defined in claim 12, wherein said first and second tongue portions extend longitudinally in spaced parallel arrangement and said second tongue comprises a yoke disposed about said first tongue portion.

15. The switch assembly defined in claim 12, wherein said first tongue portion includes stiffening means formed integrally therewith for causing said first tongue to be substantially more resistant to resilient flexing than said second tongue means.

16. The switch assembly defined in claim 12, wherein said actuation surface comprises a curved surface formed by local deformation of said strip.

17. In a single pole double throw switch having a normally closed contact set and a normally open contact set, the improvement comprising:

blade means including means defining a moveable one of said normally open and normally closed contact sets, said blade means comprising a unitary elongated strip of resilient material one end thereof fixed and said strip disposed for resilient cantilever deflection about said fixed end, said strip having formed integrally therewith a first longitudinally extending tongue portion and a second logitudinally extending tongue portion, said first tongue configured so as to be rigid and said second tongue resiliently flexible, said first and second tongue portions having the base thereof formed at a generally common longitudinal station of said strip, said first tongue portion defining an actuation surface adopted for contact with a force transmitting actuator, said strip having the stem portion thereof longitudinally intermediate said tongue base wherein, upon said actuation surface experiencing an actuation force, said stem portion is resiliently flexed causing said first tongue to open said normally closed contact set, and said second tongue is moved to effect closing of said normally open contact set, and thereafter further application of said actuation force is substantially absorbed by resilient flexing of said second tongue and said stem portion of said strip.

18. In a single pole double throw switch assembly having a normally closed contact set and a normally open contact set and moveable blade means for effecting breaking of said normally closed set and making of said normally open set, the improvement comprising:

said blade means comprising a unitary elongated strip of resiliently flexible material having;

(i) one end thereof fixed and a resiliently flexible stem portion extending in cantilever arrangement therefrom, (ii) a first tongue portion extending in cantilever from said stem portion and having one of said normally closed contact set thereon disposed adjacent or at the free end thereof said first tongue configured so as to be substantially rigid, (iii) a second tongue portion extending in cantilever from said stem portion and having one of said normally open contact set thereon disposed adjacent or at the free end thereof, said second tongue being configured so as to be resiliently flexible;

wherein, upon application of an actuation force to said first tongue portion, said stem portion flexes resiliently and said first tongue is moved to break said normally closed contact set and said second tongue is moved to close said normally open contact set, and thereafter continued application of said actuation force is absorbed by resilient flexing of said stem and said second tongue, thereby effecting a wiping action of said closed contact set.

* * * * *